US007152447B2

(12) United States Patent
Toeniskoetter

(10) Patent No.: US 7,152,447 B2
(45) Date of Patent: Dec. 26, 2006

(54) ROLLER TYPE HEMMING APPARATUS

(75) Inventor: James B. Toeniskoetter, Rochester Hills, MI (US)

(73) Assignee: Tesco Engineering, Inc., Auburn Hills, MI (US)

( * ) Notice: Subject to any disclaimer, the term of this patent is extended or adjusted under 35 U.S.C. 154(b) by 85 days.

(21) Appl. No.: 11/074,620

(22) Filed: Mar. 8, 2005

(65) Prior Publication Data

US 2005/0229666 A1 Oct. 20, 2005

Related U.S. Application Data

(60) Provisional application No. 60/557,480, filed on Mar. 30, 2004.

(51) Int. Cl.
*B21D 7/02* (2006.01)

(52) U.S. Cl. ..... 72/214; 72/210; 72/246; 29/243.58

(58) Field of Classification Search ..... 72/210, 72/214, 220, 316, 246, 466.8, 466.9; 29/243.58, 29/243.57
See application file for complete search history.

(56) References Cited

U.S. PATENT DOCUMENTS 2,796,781 A * 6/1957 Mills ..... 72/246
5,228,190 A 7/1993 Sawa
6,640,599 B1 * 11/2003 Persson ..... 72/210

* cited by examiner

*Primary Examiner*—Lowell A. Larson
*Assistant Examiner*—Teresa M Bonk
(74) *Attorney, Agent, or Firm*—Fildes & Outland, P.C.

(57) ABSTRACT

A roller type hemming apparatus includes a support member having a slide bore. A ball screw extends through the support member into the slide bore. A bearing is engaged with the ball screw inside the slide bore. The apparatus further includes a guided slide member having a first portion received in the slide bore and a second portion extending outside of the slide bore. The slide member first portion has a receiver. A resilient member is set in the receiver. The resilient member operably engages the bearing, the bearing being disposed outside of the receiver. The apparatus also includes a retaining plate having an opening therein. The retaining plate is mounted to the support member adjacent the slide bore for retaining the slide member first portion in the slide bore. A hem roller is rotatably mounted to the slide member second portion.

14 Claims, 3 Drawing Sheets

ROLLER TYPE HEMMING APPARATUS

CROSS REFERENCE TO RELATED APPLICATION

This application claims the priority of U.S. Provisional Application No. 60/557,480 filed Mar. 30, 2004.

TECHNICAL FIELD

This invention relates to a roller type hemming apparatus for edge hemming vehicle closure panels such as hemming of door panels, hood panels, and decklid panels.

BACKGROUND OF THE INVENTION

It is known in the vehicle closure panel hemming art that roller hemmers can be used to hem the edges of metal, for example aluminum, automotive parts such as door panels, hood panels, and decklid panels.

Conventionally, roller hemming apparatus may be mounted to a multi-axis controllable robot and may include a hem roller carried by a support. The conventional hemming apparatus is adapted for hemming a bent portion of a workpiece, such as a door panel, positioned on a hemming die, by rotating the hem roller under pressure along the bent portion. The conventional roller type hemming apparatus can thus be used for continuous hemming along the contour of the edge of the workpiece.

In order to achieve good hemming with such a conventional roller hemming apparatus, however, the robot must move the hem roller along the edge of the workpiece at a constant distance from the hemming die. The robot is not composed of a perfectly rigid body, and when the hem roller is positioned against the edge of the workpiece, the robot may be deflected by its own resiliency or by a repulsive force exerted by the edge of the workpiece itself. This results in interruption of the pressing force applied by the hem roller and therefore imperfect hemming of the workpiece. Springs have been disposed in the hemming roller support to compensate for the interrupted pressing force, but alone springs have proven inefficient and unpredictable.

Further, the edge of a workpiece to be hemmed may also have a complex configuration. This makes it difficult for a conventional hemming apparatus to achieve adequate hemming of the workpiece.

SUMMARY OF THE INVENTION

The present invention provides a roller type hemming apparatus which includes a hem roller that can accurately follow the configuration of a bent portion of a workpiece to be hemmed and more accurately and uninterruptably apply a consistent hemming force.

The present invention also provides a roller type hemming apparatus wherein deflection of the hem roller is limited to a settable range limited by an adjustable pressure applied on a slideable guide member that supports the hem roller.

More particularly, a roller type hemming apparatus includes a support member having a slide bore, a ball screw extending through the support member into the slide bore, and a bearing engaged with the ball screw inside the slide bore. The apparatus further includes a guided slide member having a first portion received in the slide bore and a second portion extending outside of the slide bore. The slide member first portion has a receiver. A preloaded resilient member preloadable in the slide member compression bore operably engages the bearing. The bearing is disposed outside of the slide member receiver. The apparatus further includes a retaining plate and a hem roller. The retaining plate has an opening therein and is mounted to the support member adjacent the slide bore for retaining the slide member first portion in the slide bore. The hem roller is rotatably mounted to the second portion of the slide member. Rotating the ball screw moves the bearing inside the slide bore, sliding the slide member to selectively compress and decompress the resilient member to establish a preload force and delimited range of deflection of the hem roller.

In a specific embodiment, the support member may include a support bearing for supporting the ball screw in the support member. The apparatus may further include a first retaining clip interposed between the bearing and the resilient member and a second clip engaged with the resilient member opposite the bearing.

A load cell may be inside of the slide member receiver for loading the resilient member. A guide bearing may be positioned between the slide member and the support member slide bore for guiding the travel of the slide member. The opening in the retaining plate may be wider than the slide member second portion and narrower than the slide member first portion such that the slide member first portion is retained in the support member slide bore. The resilient member may be a spring.

A servo motor assembly may be mounted to an outer surface of the support member. The servo motor assembly may include a servo motor, a drive shaft operably connected to the motor, and a pulley on the drive shaft. The ball screw may include a pulley and the ball screw pulley may be operably connected to the servo pulley by a belt. The servo motor assembly may also include a brake for slowing the rotation of the pulley.

The apparatus may be adapted for operable connection to a work arm of a multi-axis robot and may be fastened to a forward end of a hand of the robot.

With the above construction, as the hem roller is displaceable in a direction corresponding to the pressing direction of the robot hand, deflection of the robot hand or any difference between the traveling path of the robot hand and the peripheral contour of the workpiece can be absorbed, permitting the hem roller to accurately follow up the bent portion of the workpiece.

These and other features and advantages of the invention will be more fully understood from the following detailed description of the invention taken together with the accompanying drawings.

DETAILED DESCRIPTION OF THE INVENTION

Figure 1:
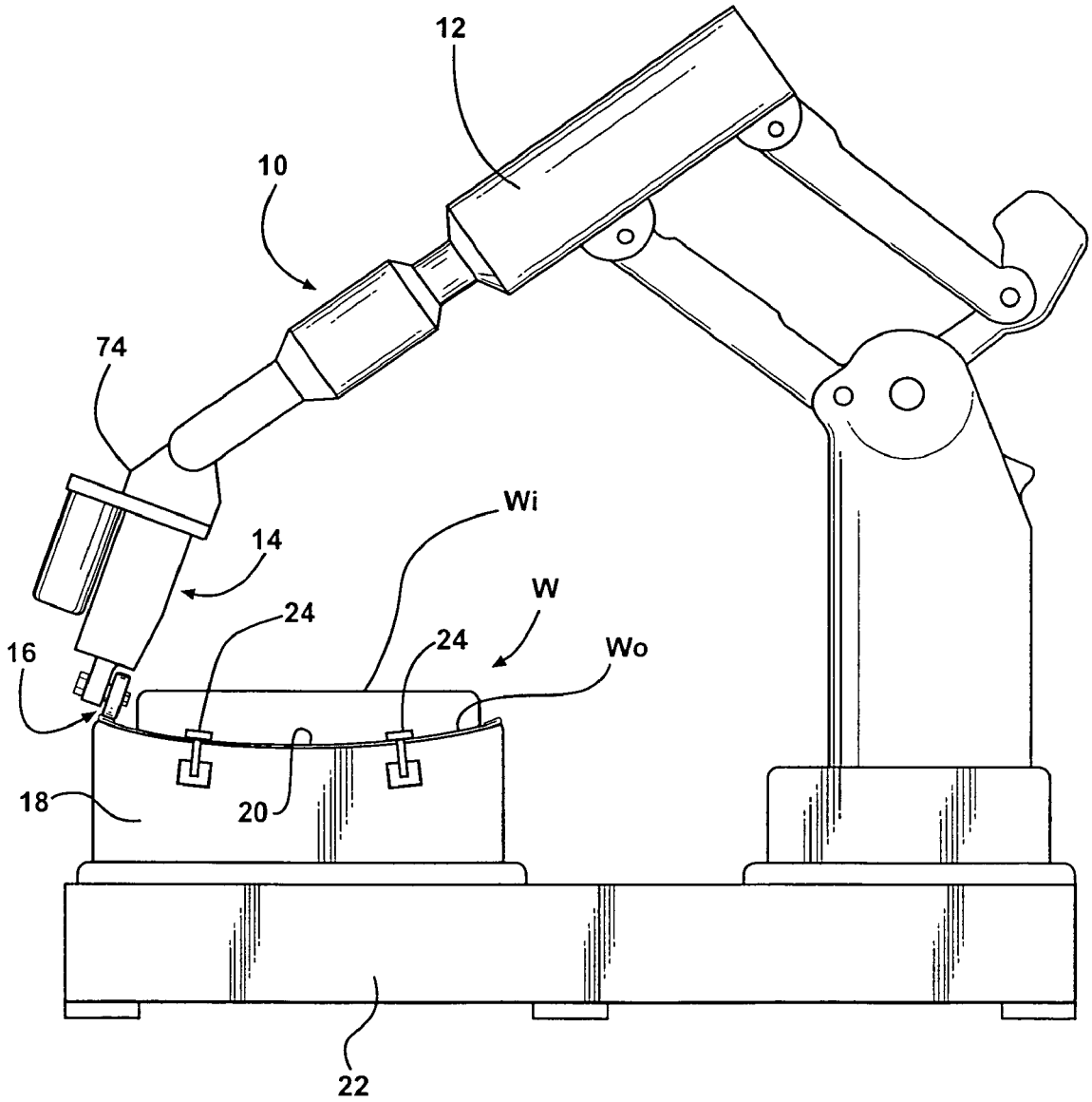
FIG. 1 is an environmental view of a roller type hemming apparatus in accordance with the present invention hemming a workpiece with the aid of a robot hand.

Referring now to the drawings in detail and to FIG. 1 in particular, a roller type hemming apparatus 10 in accordance with the present invention is adapted for operable connection to a work arm, such as a multi-axis controllable robot hand 12 to which a predetermined traveling path may be preliminarily taught. The roller type hemming apparatus 10 includes a hem roller support 14 mounted on the forward end of the robot hand 12, and a hem roller 16 displaceably supported by the hem roller support 14 to be pressed against a workpiece W.

The workpiece W is, for example, a door panel composed of an outer panel Wo and an inner panel Wi. The outer panel Wo has a peripheral portion preliminarily bent upwardly substantially at right angles, and the inner panel Wi has a peripheral stepped portion extending outwardly (see for example FIG. 1). The outer panel Wo and the inner panel Wi are placed on a lower die 18 with the stepped portion of the inner panel Wi arranged along the inside of the bent portion of the outer panel Wo. The lower die 18 has an upper surface constituting a forming surface 20 and is placed on a common base 22 on which the hemming apparatus 10 is placed at a predetermined distance away from the lower die 18. The workpiece W is placed on the forming surface 20 of the lower die 18 and is secured thereto by fixtures 24.

As the robot hand 12 is well known in the art, its description will be omitted, and the hem roller support 14 and the hem roller 16 will be described in detail.

Figure 2:
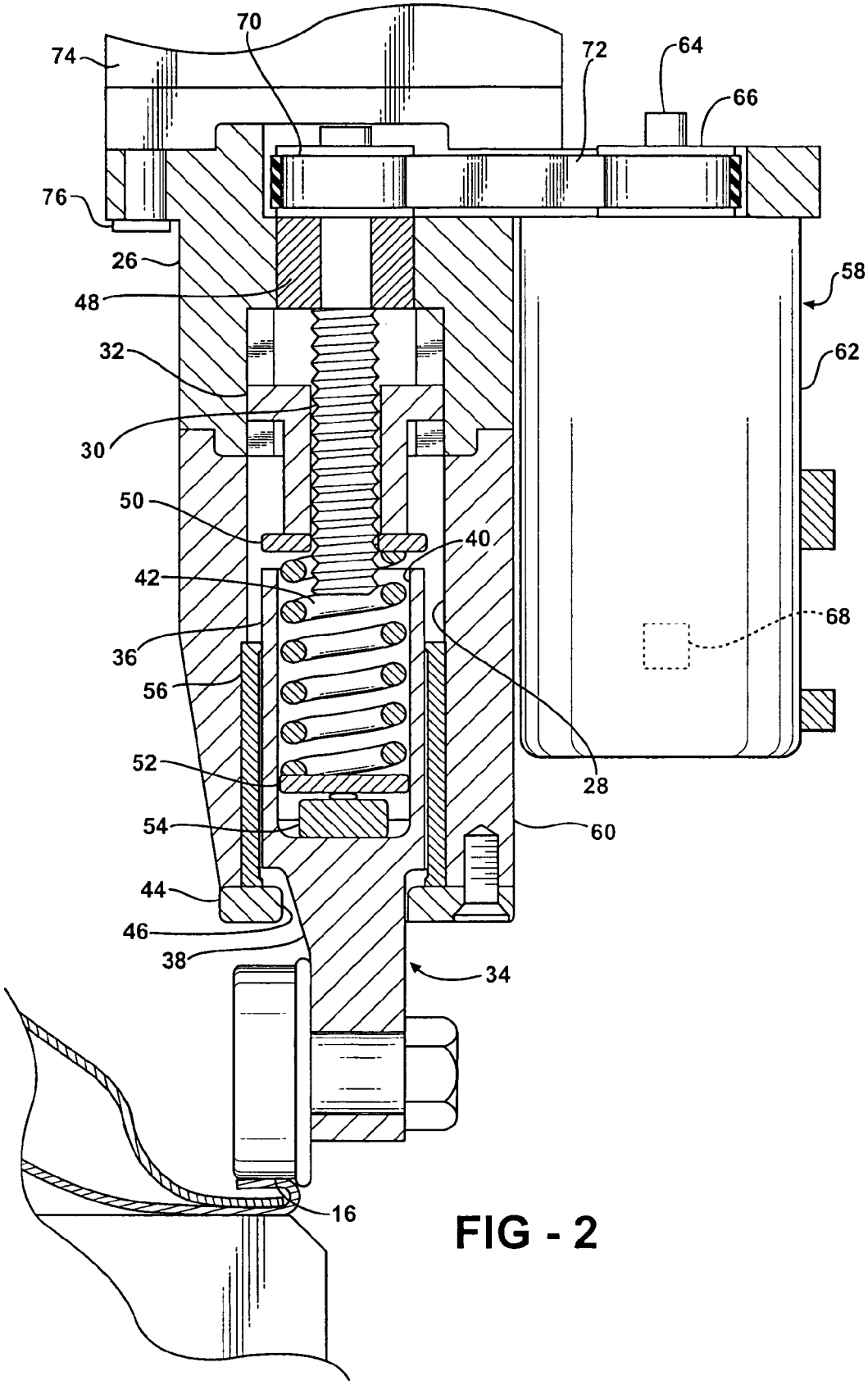
FIG. 2 is a sectional view of a hem roller support of the roller type hemming apparatus of FIG. 1.

As shown in FIG. 2, a hem roller support 14 of a roller hemming apparatus 10 in accordance with the present invention includes a support member 26 having a slide bore 28. A ball screw 30 extends through the support member 26 into the slide bore 28. A bearing 32, such as a roller bearing or similar, is engaged with the ball screw 30 inside the slide bore 28. The invention further includes a guided slide member 34 having a first portion 36 received in the slide bore 28 and a second portion 38 extending outside of the slide bore 28. The slide member first portion 36 has a receiver 40. A resilient member 42, such as a spring or similar, is set in the slide member receiver 40. The resilient member 42 operably engages the bearing 32, the bearing 32 being disposed outside of the slide member receiver 40.

The present invention also includes a retaining plate 44 having an opening 46 therein. The retaining plate 44 is mounted to the support member 26 adjacent the slide bore 28 for retaining the slide member first portion 36 in the slide bore 28. A hem roller 16 is rotatably mounted to the second portion 38 of the slide member 34, for example by a nut and bolt shaft assembly. Rotating the ball screw 30 moves the bearing 32 inside of the slide bore 28, thereby sliding the slide member 34 and compressing and decompressing the resilient member 42 to preload the resilient member, establishing a preload force and delimited range of deflection of the hem roller 16.

In a specific embodiment, the support member 26 may include a support bearing 48 for supporting the ball screw 30 in the support member 26. A first retaining clip 50 may be interposed between the bearing 32 and the resilient member 42. A second retaining clip 52 may be engaged with the resilient member 42 opposite the bearing 32. A load cell 54 may be located inside of the slide member receiver 40 for loading the resilient member 42. A guide bearing 56 may be positioned between the slide member 34 and the support member slide bore 28 for guiding the travel of the slide member 34. The opening 46 in the retaining plate 44 may be wider than the slide member second portion 38 and narrower than the slide member first portion 36 such that the slide member first portion 36 is retained in the support member slide bore 28.

A servo motor assembly 58 may be mounted to an outside surface 60 of the support member 26. The servo motor assembly 58 may include a servo motor 62, a drive shaft 64 operably connected to the motor 62, and a pulley 66 on the drive shaft 64. The servo motor assembly 58 may also include a brake 68 for slowing the rotation of the pulley 66. The ball screw 30 may also include a pulley 70 operably connected to the servo pulley 66 by a belt 72.

The servo motor 62 rotates the pulley 66 which through the belt 72 rotates the ball screw pulley 70. In so doing, the ball screw 30 is rotated inside the bearing 32. This moves the bearing 32 upward or downward depending on the direction of the rotation of the ball screw 30. In a downward rotation, the ball screw 30 rotates inside the bearing 32 causing the bearing along with the first retaining clip 50 to travel downward. This motion applies pressure to and compresses the resilient member 42 onto the second retaining clip 52. This action causes the second retaining clip 52 to apply pressure on the load cell 54 and to move the guided slide member 34 against the retaining plate 44 until a pre-set pressure is obtained. In an upward rotation, the opposite occurs. The ball screw 30 causes the bearing 32 and the first retaining clip 50 to travel upward. This releases pressure on the resilient member 42 and also causes the slide member 34 to move upward when the resilient member 42 is completely decompressed.

The apparatus may be fastened to the forward end 74 of a robot hand 12 by, for example, a fastener 76.

Figure 3:
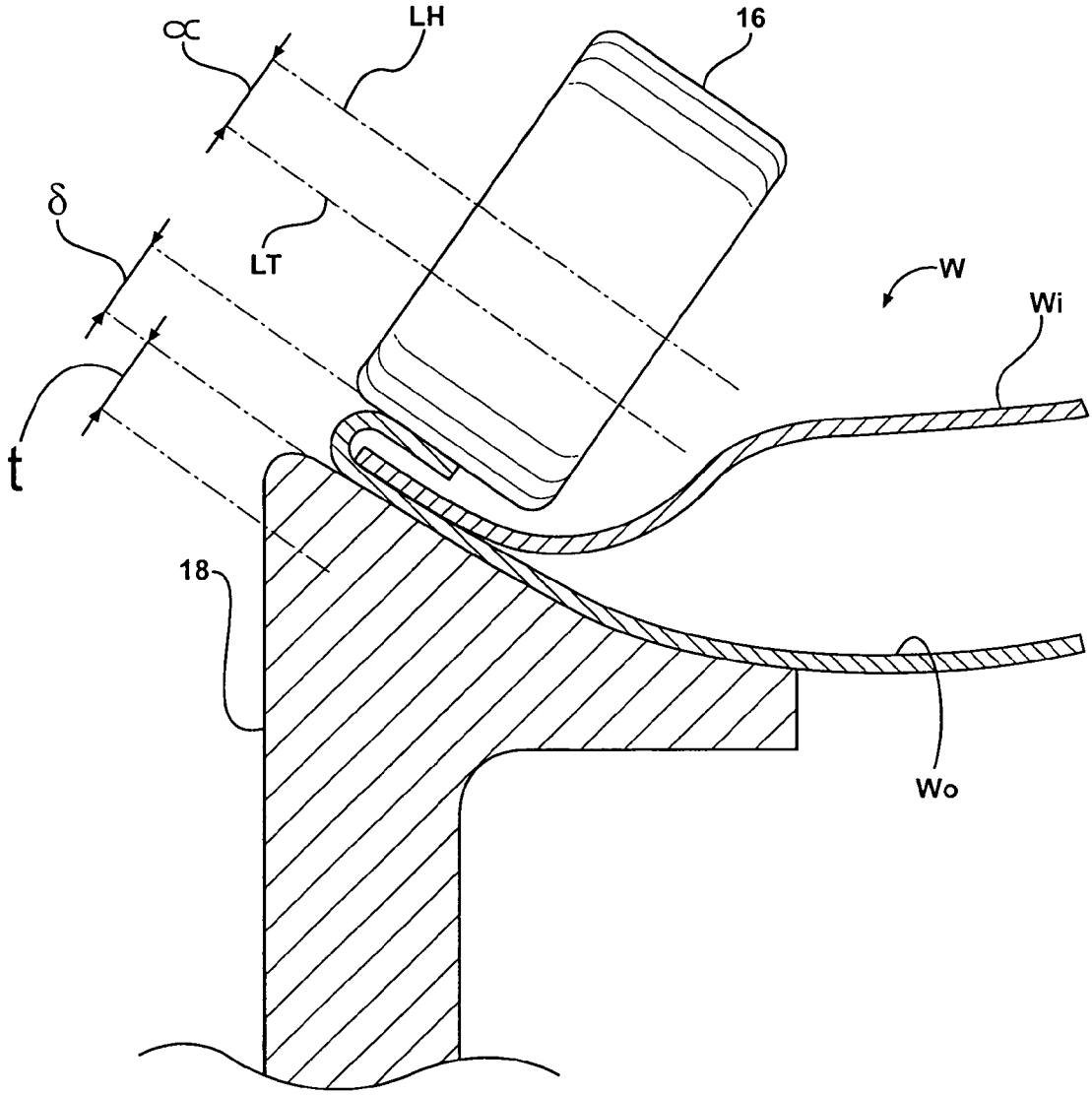
FIG. 3 is a perspective view illustrating the hemming operation.

During the hemming operation, the workpiece W is placed on the forming surface 20 of the lower die 18, as shown in FIG. 3. During the hemming operation, the hem roller 16 is pressed with a preset predetermined pressing force against the bent portion of the workpiece W, and a repulsive force of the bent portion causes the robot hand 12 to be deflected in a direction away from the bent portion. The hem roller 16 can be maintained on the hemming level LH, even when the robot hand 12 is deflected within the range limited by the pre-determined pressure applied on the guided slide member 34 in the process described above to maintain a maximum distance corresponding to the thickness t. Thus, the deflection of the robot hand 12 is absorbed and the hem roller 16 is always held on the hemming level LH, permitting the pressing force of the hem roller 16 to be maintained at a proper value to achieve good hemming.

As described above, as the guided slide member 34 and consequently the hem roller 16 is displaceable with respect to the support member 26 and consequently the robot hand 12, deflection of the robot hand 12, or the difference in the traveling path of the hem roller 16 with respect to the workpiece W, can be absorbed. This permits the hem roller 16 to constantly follow up the bent portion of the workpiece W exactly and to be constantly pressed with a proper pressing force for good hemming.

It is essential to the present invention that the hem roller 16 is displaceable with respect to the robot hand 12, the position of the hem roller 16 being controlled by the position controlling means of the guided slide member 34 and bearing 32 assembly. Therefore, teaching of the robot hand 12 can be readily carried out, and during the hemming operation, the position of the hem roller 16 can be constantly held on the hemming level LH to achieve good hemming at all times.

Thus, in the hemming apparatus of the present invention, as the hem roller is rotated under a proper pressing force in an accurate traveling path along the peripheral contour of a workpiece, hemming can always be satisfactorily carried out. In addition, teaching of the robot hand can be readily carried out in the present invention.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A roller type hemming apparatus comprising:

a support member having a slide bore;

a ball screw extending through said support member into said slide bore;

a bearing engaged with said ball screw inside said slide bore;

a guided slide member having a first portion received in said slide bore and a second portion extending outside of said slide bore;

said slide member first portion having a receiver;

a preloadable resilient member preloadable in said slide member receiver, said resilient member operably engaging said bearing;

said bearing being disposed outside of said slide member receiver;

a retaining plate having an opening therein, said retaining plate being mounted to said support member adjacent said slide bore for retaining said slide member first portion in said slide bore; and a hem roller rotatably mounted to the second portion of said slide member;

whereby rotating said ball screw moves said bearing inside said slide bore, sliding said slide member to selectively compress and decompress said resilient member to establish a preload force and delimited range of deflection of said hem roller.

2. The roller type hemming apparatus of claim 1, wherein said support member includes a support bearing for supporting said ball screw in said support member.

3. The roller type hemming apparatus of claim 1, further including a first retaining clip interposed between said bearing and said resilient member.

4. The roller type hemming apparatus of claim 1, further including a second retaining clip engaged with said resilient member opposite said bearing.

5. The roller type hemming apparatus of claim 1, further including a load cell inside of said slide member receiver for loading said resilient member.

6. The roller type hemming apparatus of claim 1, further including a guide bearing positioned between said slide member and said support member slide bore for guiding the travel of said slide member.

7. The roller type hemming apparatus of claim 1, wherein the opening in said retaining plate is wider than said slide member second portion and narrower than said slide member first portion such that said slide member first portion is retained in said support member slide bore.

8. The roller type hemming apparatus of claim 1, wherein said resilient member is a spring.

9. The roller type hemming apparatus of claim 1, further including a servo motor assembly mounted to an outer surface of said support member, said servo motor assembly including a servo motor, a drive shaft operably connected to said motor, and a pulley on said drive shaft.

10. The roller type hemming apparatus of claim 9, wherein said servo motor assembly includes a brake for slowing the rotation of the pulley.

11. The roller type hemming apparatus of claim 9, wherein said ball screw includes a pulley and said ball screw pulley is operably connected to said servo pulley by a belt.

12. The roller type hemming apparatus of claim 1, wherein said apparatus is adapted for operable connection to a work arm of a multi-axis robot.

13. The roller type hemming apparatus of claim 12, wherein said apparatus is fastened to a forward end of a hand of said robot.

14. A method of roller hemming, the method comprising the step of:

providing a roller type hemming apparatus including:

a support member having a slide bore;

a ball screw extending through said support member into said slide bore;

a bearing engaged with said ball screw inside said slide bore;

a guided slide member having a first portion received in said slide bore and a second portion extending outside of said slide bore;

said slide member first portion having a receiver;

a preloadable resilient member preloadable in said slide member receiver, said resilient member operably engaging said bearing;

said bearing being disposed outside of said slide member receiver;

a retaining plate having an opening therein, said retaining plate being mounted to said support member adjacent said slide bore for retaining said slide member first portion in said slide bore; and a hem roller rotatably mounted to the second portion of said slide member;

whereby rotating said ball screw moves said bearing inside said slide bore, sliding said slide member to selectively compress and decompress said resilient member to establish a preload force and delimited range of deflection of said hem roller.

* * * * *